US011761698B2

(12) United States Patent
Kalambe et al.

(10) Patent No.: US 11,761,698 B2
(45) **Date of Patent: *Sep. 19, 2023**

(54) DEFROST CYCLE CONTROL ASSEMBLY IN A HEAT PUMP

(71) Applicant: Rheem Manufacturing Company, Atlanta, GA (US)

(72) Inventors: Aniket R. Kalambe, Fort Smith, AR (US); Walter R. Lowrimore, Fort Smith, AR (US); Neil D. Hurt, Fort Smith, AR (US); Michael Andrews, Fort Smith, AR (US); Randy Foster, Fort Smith, AR (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 89 days.

This patent is subject to a terminal disclaimer.

(21) Appl. No.: 17/359,787

(22) Filed: Jun. 28, 2021

(65) Prior Publication Data

US 2021/0396451 A1 Dec. 23, 2021

Related U.S. Application Data

(63) Continuation of application No. 16/365,282, filed on Mar. 26, 2019, now Pat. No. 11,047,610.

(51) Int. Cl.
*F25D 21/00* (2006.01)
*F25B 13/00* (2006.01)

(52) U.S. Cl.
CPC ..... *F25D 21/006* (2013.01); *F25B 13/00* (2013.01)

(58) Field of Classification Search
CPC ..... F25D 1/002; F25D 1/006; F25B 13/00; F25B 47/02; F25B 47/025; F25B 2347/02; F25B 2347/023; F25B 2700/02; F25B 2700/11; F25B 2700/2116; F25B 2700/2117
See application file for complete search history.

(56) References Cited

U.S. PATENT DOCUMENTS 4,215,554 A * 8/1980 Pohl ..... F24F 11/30 62/209
5,499,508 A * 3/1996 Arai ..... F25B 9/006 62/502
11,047,610 B2 * 6/2021 Kalambe ..... F25B 47/025
(Continued)

*Primary Examiner* — Marc E Norman
(74) *Attorney, Agent, or Firm* — EVERSHEDS SUTHERLAND (US) LLP

(57) ABSTRACT

A defrost cycle control assembly includes a first sensor that is configured to measure a temperature adjacent a top portion of an outdoor heat exchanger of a heat pump, a second sensor that is configured to measure a temperature adjacent a bottom portion of the outdoor heat exchanger, and a third sensor that is configured to measure an ambient temperature. Further, the defrost cycle control assembly includes a controller that is configured to initiate a defrost cycle of the heat pump based on the temperature adjacent the top portion and the ambient temperature when said temperatures indicate formation of frost at the top portion of the outdoor heat exchanger where the first sensor is disposed. The controller is configured to terminate the defrost cycle when the temperature at the bottom portion reaches a termination temperature which indicates that the frost on the outdoor heat exchanger has melted.

17 Claims, 6 Drawing Sheets

(56) References Cited

U.S. PATENT DOCUMENTS

| | | | | |
|---|---|---|---|---|
| 2015/0283978 | A1* | 10/2015 | Miyakoshi | F25B 49/022 62/140 |
| 2016/0238301 | A1* | 8/2016 | Denton | F24F 11/30 |
| 2018/0031289 | A1* | 2/2018 | Hern | F25B 47/025 |

* cited by examiner

DEFROST CYCLE CONTROL ASSEMBLY IN A HEAT PUMP

CROSS REFERENCE TO RELATED APPLICATIONS

This present application is a continuation of U.S. patent application Ser. No. 16/365,282, filed Mar. 26, 2019, the entire disclosure disclosures of which is hereby incorporated herein by reference.

TECHNICAL FIELD

The present disclosure relates generally to temperature control systems, and more particularly to a defrost cycle control assembly in temperature control systems, such as a heat pump.

BACKGROUND

A temperature control system such as a heat pump is a compression cycle-based refrigeration system that can be reversed to either heat or cool a controlled space. The heat pump (e.g., split heat pump) includes an indoor unit that comprises an expansion valve and an indoor heat exchanger, and an outdoor unit that comprises an outdoor heat exchanger and a compressor. The compressor circulates refrigerant that absorbs and releases heat as it travels between the indoor unit and the outdoor unit of the heat pump.

When the heat pump operates in the heating mode, the indoor heat exchanger acts as a condenser and the outdoor heat exchanger acts as an evaporator. In the heating mode, under certain conditions of temperature and relative humidity, vapor from ambient air condenses and freezes on the heat exchanging surfaces of the outdoor heat exchanger and forms a continuously increasing layer of frost (ice) over time. It is known that the layer of frost will interfere with the operation of the heat pump by making the pump work harder and, therefore, inefficiently. The heat pump has a cycle called a defrost cycle, which removes the frost from the heat exchanging surfaces of the outdoor heat exchanger. In the defrost cycle, the heat pump is operated in reverse, i.e., in the cooling mode. This action temporarily warms up the outdoor heat exchanger and melts the frost from the coil. During the defrost cycle in which the heat pump runs in a cooling mode, electric heat may be used to heat the controlled space. Thus, the defrost cycle should be long enough to melt the ice, but also short enough to be energy-efficient (e.g., reduce usage of electric heat).

Conventional heat pumps use a single sensor (excluding an ambient sensor) to control (e.g., start and stop) the defrost cycle. Said single sensor is typically positioned on a liquid line of the heat pump near an inlet end (when running in a heating mode) of the outdoor heat exchanger. Said single sensor measures surface temperature of the outdoor heat exchanger at the inlet end and uses the measured surface temperature to trigger the defrost cycle when a frost condition is detected at the inlet end of the outdoor heat exchanger. Further, the defrost cycle is stopped when the same sensor determines that a termination temperature has been reached, the termination temperature indicating that the frost on the outdoor heat exchanger adjacent the inlet end has been melted. In other words, in conventional heat pumps, the defrost cycle is controlled based on the detection of frost at the inlet end or at the bottom of the outdoor heat exchanger.

In heat pumps that use a micro-channel heat exchanger as the outdoor heat exchanger, typically, the refrigerant may be fed at the bottom of the outdoor heat exchanger and output at the top of the outdoor heat exchanger during the heating mode. Accordingly, in said outdoor micro-channel heat exchanger, frost may build from the bottom of the heat exchanger towards the top of the heat exchanger during the heating mode when the outdoor micro-channel heat exchanger operates as an evaporator. In said heat pumps that include the outdoor micro-channel heat exchanger, controlling the defrost cycle based on detecting frost at the inlet end or at the bottom of the outdoor heat exchanger results in the heat pump going into frequent defrost cycles even when most of the heat exchanging surface (e.g., at the top and middle portions) of the outdoor heat exchanger is clean, i.e., does not have frost/ice formed thereon. The frequent unnecessary defrost cycles reduce the heating period for the customer and lead to higher energy consumption from the use of electric heat during the defrost cycles.

Further, frequently entering the defrost cycle while most of the heat exchanging surface (e.g., top or middle portions) of the outdoor micro-channel heat exchanger is clean causes the top portion of the outdoor micro-channel heat exchanger to get extremely hot from the hot refrigerant entering at the top of the outdoor micro-channel heat exchanger (cooling mode operation). This in turn leads to a large temperature gradient between the top portion and the bottom portion of the outdoor micro-channel heat exchanger. Such large temperature gradients may also cause pressure variations which in turn trigger the pressure switches of the heat pump and cause the heat pump to shut down. Furthermore, entering the defrost cycle while most of the heat exchanging surface is clean results in an inefficient use of the outdoor heat exchanger. Additionally, the frequent defrost cycles may increase component load and reduce component life.

It is noted that this background information is provided to reveal information believed by the applicant to be of possible relevance to the present disclosure. No admission is necessarily intended, nor should be construed, that any of the preceding information constitutes prior art against the present disclosure.

SUMMARY

In one aspect, the present disclosure is related to a defrost cycle control assembly of a heat pump that has an outdoor heat exchanger disposed in an outdoor unit of the heat pump. The defrost cycle control assembly includes a first sensor that is configured to measure a temperature at a first portion of the outdoor heat exchanger, a second sensor that is configured to measure a temperature at a second portion of the outdoor heat exchanger, the first portion being spaced apart from the second portion, and a third sensor configured to measure an ambient temperature at the outdoor unit. Further, the defrost cycle control assembly includes a controller that is communicatively coupled to the first sensor, the second sensor, and the third sensor. The controller configured to initiate a defrost cycle of the heat pump based on the temperature at the first portion of the outdoor heat exchanger and the ambient temperature. Further, the controller is configured to terminate the defrost cycle based on the temperature at the second portion of the outdoor heat exchanger.

In another aspect, the present disclosure is related to a heat pump that includes an outdoor unit. The outdoor unit includes an outdoor heat exchanger and a defrost cycle control assembly. The defrost cycle control assembly includes two sensors that are configured to measure surface temperatures at two different portions of the outdoor heat exchanger that are spaced apart from each other, and a controller that is communicatively coupled to the two sensors and configured to control a defrost cycle of the heat pump based on the surface temperatures at the two different portions of the outdoor heat exchanger.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1A:
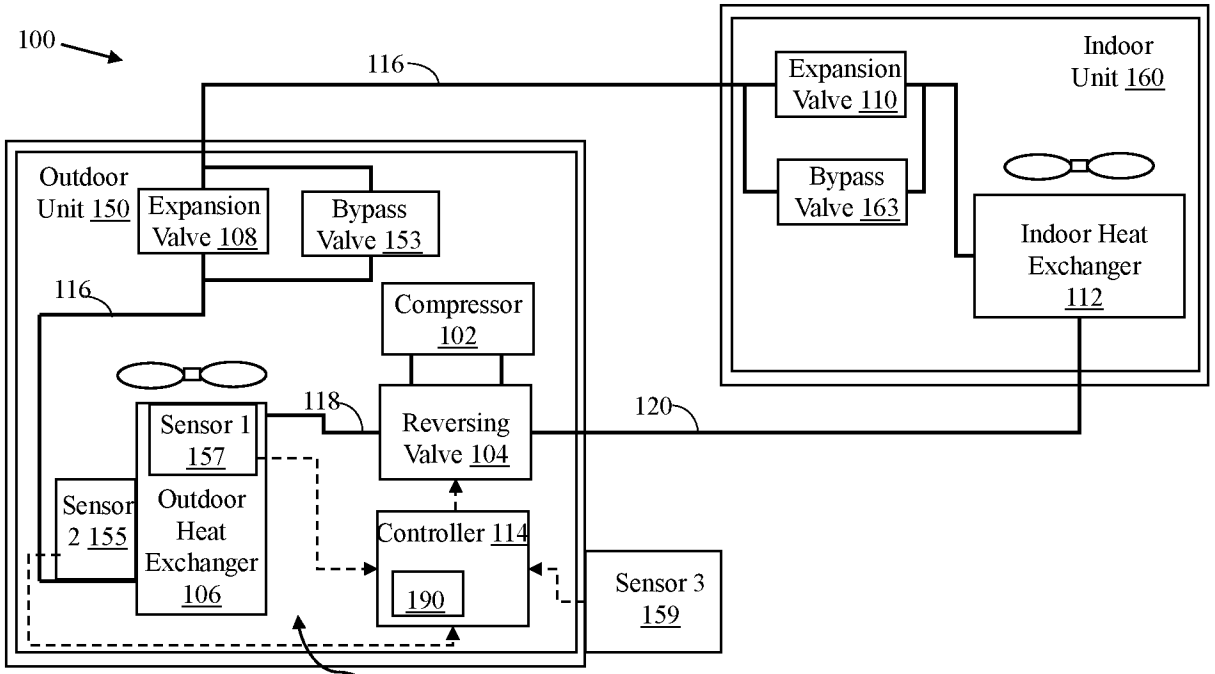
FIGS. 1A and 1B (collectively 'FIG. 1') illustrates a schematic diagram of a defrost cycle control assembly and an example heat pump with the example defrost cycle control assembly disposed therein, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis is instead placed on clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes an example defrost cycle control assembly that uses multiple sensors to control a defrost cycle of an example heat pump that includes an outdoor micro-channel heat exchanger. The example defrost cycle control assembly of the present disclosure is configured to optimize the defrost cycle of the heat pump by inducing the defrost cycle only when frost covers a majority of the heat exchanging surface, i.e., from the bottom portion or inlet portion to the top portion or outlet portion of the outdoor micro-channel heat exchanger. For example, the example defrost cycle control assembly may be configured to initiate a defrost cycle only when the frost that is formed on the heat exchanging surface of the outdoor micro-channel heat exchanger extends from the bottom portion of the outdoor micro-channel heat exchanger to the top portion thereof.

In other words, unlike conventional heat pumps in which the defrost cycle is triggered based on the amount of frost that is present at or adjacent one portion (e.g., bottom portion or inlet portion) of the outdoor heat exchanger, the example defrost cycle control assembly of the present disclosure is configured to induce the defrost cycle based on the amount of frost that forms across the entirety of the heat exchanging surface, i.e., from a bottom portion to a top portion (or an inlet portion to an outlet portion) of the outdoor heat exchanger. Consequently, the example defrost cycle control assembly reduces the number of defrost cycles of a heat pump and extends the time between consecutive defrost cycles of the heat pump. Reducing the number of defrost cycles and extending the time between consecutive defrost cycles leads to: extended heating period for the customer, lower energy consumption by not using electric heat, and extended component life by decreasing component load.

Further, the example defrost cycle control assembly of the present disclosure enables optimum use of the heat exchanging surface area under frost conditions for heat transfer and run time. Furthermore, the example defrost cycle control assembly of the present disclosure minimizes the temperature gradient from the top portion through bottom portion of the of the outdoor micro-channel heat exchanger, which in turn remediates the triggering of the pressure switches and resulting shut down of the heat pump. Additionally, the example defrost cycle control assembly of the present disclosure protects the heat pump against maldistribution of refrigerant through and air over the outdoor micro-channel heat exchanger (a section (e.g., top portion) of the outdoor micro-channel heat exchanger getting very hot compared to remainder of the heat exchanger).

The example defrost cycle control assembly of the present disclosure includes two temperature sensors disposed at two different locations of the outdoor micro-channel heat exchanger to measure the surface temperatures at the two different locations of the outdoor micro-channel heat exchanger. For example, a first temperature sensor may be disposed on the outdoor micro-channel heat exchanger at a top portion thereof, and a second temperature sensor may be disposed on a liquid line adjacent an inlet end of the outdoor micro-channel heat exchanger of the heat pump. The first temperature sensor may be configured to measure a first surface temperature at the top portion of the outdoor micro-channel heat exchanger and the second temperature sensor may be configured to measure a second surface temperature of the liquid line at a bottom portion of the outdoor micro-channel heat exchanger.

Further, the example defrost cycle control assembly of the present disclosure includes a controller that is coupled to the two temperature sensors. The controller may include a defrost cycle control engine that may be configured to receive the measured surface temperatures at the top portion and the bottom portion of the outdoor micro-channel heat exchanger from the two temperature sensors. Responsively, the defrost cycle control engine may control the defrost cycle of the heat pump based on the received surface temperatures. For example, the defrost cycle control engine may initiate the defrost cycle based on the first surface temperature at the top portion of the outdoor micro-channel heat exchanger, e.g., when the first surface temperature indicates that frost has reached or built up to the top portion of the outdoor micro-channel heat exchanger where the first temperature sensor is placed. Further, the defrost cycle control engine may terminate the defrost cycle based on the second surface temperature at the bottom portion of the outdoor micro-channel heat exchanger, e.g., when the second surface temperature reaches a preset termination temperature that indicates that the frost on the outdoor micro-channel heat exchanger has melted all the way to the bottom portion where the second temperature sensor is placed.

Example embodiments of a heat pump with a defrost cycle control assembly will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the defrost cycle control assembly of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the defrost cycle control assembly of the present disclosure can be disposed in a heat pump that is located in any type of environment (e.g., warehouse, attic, garage, storage, mechanical room, basement) for any type (e.g., commercial, residential, industrial) of user.

Even though the present disclosure describes the defrost cycle control assembly as being configured for use with a heat pump having an outdoor micro-channel heat exchanger, one of skill in the art can understand and appreciate that in other example embodiments, the defrost cycle control assembly can be used with any other appropriate temperature control systems that can operate in both heating and cooling mode and have any other appropriate outdoor heat exchanger without departing from a broader scope of the present disclosure.

Before discussing the example embodiments directed to the defrost cycle control assembly, it may assist the reader to understand the various terms used herein by way of a general description of the terms in the following paragraphs.

The term 'bottom portion of the heat exchanging surface of the outdoor heat exchanger' or 'bottom end of the outdoor heat exchanger' or 'bottom portion of the outdoor heat exchanger' as used herein may generally refer to a portion of the heat exchanging surface or an end of the heat exchanger that is positioned closest to the ground or the mounting surface on which the outdoor heat exchanger is mounted. Further, the term 'top portion of the heat exchanging surface of the outdoor heat exchanger' or 'top end of the outdoor heat exchanger' or 'top portion of the outdoor heat exchanger' as used herein may generally refer to a portion of the heat exchanging surface or an end of the heat exchanger that is farthest away from the ground or the mounting surface on which the outdoor heat exchanger is mounted.

Turning now to the figures, example embodiments of a defrost cycle control assembly will be described in association with FIGS. 1-3. In particular, an example heat pump with the example defrost cycle control assembly of the present disclosure will be described in connection with FIG. 1; and an example method of controlling a defrost cycle of the example heat pump of FIG. 1 using the defrost cycle control assembly will be described in connection with FIG. 3 by referring to FIGS. 1 and 2 as needed.

Referring to FIG. 1, an example heat pump 100 for providing conditioned air to a temperature-controlled space such as a building may include an indoor unit 160 that is disposed in the building and an outdoor unit 150 that is disposed outside or external to the building. The outdoor unit 150 may include a compressor 102, a reversing valve 104, an outdoor heat exchanger 106, a first expansion valve 108, a first bypass valve 153, and a controller 114. Further, the indoor unit 160 may include a second expansion valve 110, a second bypass valve 163, and an indoor heat exchanger 112. The outdoor and indoor units (150, 160) and the components (102, 104, 106, 108, 110, 112, 153, 163) thereof may be coupled to each other using refrigerant lines to form a closed loop. For example, the indoor heat exchanger 112 may be coupled to the outdoor heat exchanger 106 via a liquid line 116. Further, the indoor heat exchanger 112 may be coupled to the compressor 102 through the reversing valve 104 via a suction line 120, and the compressor 102 may be coupled to the outdoor heat exchanger 106 through the reversing valve 104 via a discharge line 118.

In one example embodiment, the outdoor heat exchanger 106 and/or the indoor heat exchanger 112 may be micro-channel heat exchangers. However, in other example embodiments, the outdoor heat exchanger 106 and/or the indoor heat exchanger 112 may include any other appropriate type of heat exchanger without departing from a broader scope of the present disclosure.

The compressor 102 of the heat pump 100 may be configured to circulate refrigerant through the heat pump 100. Further, the reversing valve 104 may be configured to control a direction of flow of the refrigerant in the heat pump 100 based on a mode of operation of the heat pump 100 (e.g., a heating mode or a cooling mode). A process of heating and cooling a temperature-controlled space by a heat pump 100 is well known and will only be briefly summarized herein for the sake brevity and so as not to obscure the defrost cycle control mechanism of the heat pump 100.

In the cooling mode of operation, the compressor 102 receives gaseous refrigerant that has absorbed heat from the environment of the indoor heat exchanger 112 via the suction line 120. The gaseous refrigerant is compressed by the compressor 102 and discharged, at high pressure and relatively high temperature, to the outdoor heat exchanger 106 via the discharge line 118. Heat is transferred from the high-pressure refrigerant to the environment of the outdoor heat exchanger 106 and the refrigerant condenses in the outdoor heat exchanger 106. The liquid line 116 passes the condensed refrigerant from the outdoor heat exchanger 106 to the indoor heat exchanger 112 through the first bypass valve 153 and the second expansion valve 110. The refrigerant gains heat and is evaporated in the indoor heat exchanger 112. Further, the gaseous refrigerant returns to the compressor 102.

In other words, in the cooling mode of operation, the indoor heat exchanger 112 is configured to operate as an evaporator that absorbs heat from the indoor air, the outdoor heat exchanger 106 is configured to operate as a condenser that expels heat to the outdoor air, and the reversing valve 104 is configured to direct gaseous refrigerant from the indoor heat exchanger 112 to the compressor 102 and liquid refrigerant at a high pressure and high temperature from the compressor 102 to the outdoor heat exchanger 106.

In the heating mode of operation, the refrigerant flow in the heat pump 100 may be reversed by the reversing valve 104. That is, in the heating mode of operation, the compressor 102 receives gaseous refrigerant that has absorbed heat from the environment of the outdoor heat exchanger 106 via the discharge line 118. The gaseous refrigerant is compressed by the compressor 102 and discharged, at high pressure and relatively high temperature, to the indoor heat exchanger 112 via the suction line 120. Heat is transferred from the high-pressure refrigerant to the environment of the indoor heat exchanger 112 and the refrigerant condenses in the indoor heat exchanger 112. The liquid line 116 passes the condensed refrigerant from the indoor heat exchanger 112 to the outdoor heat exchanger 106 through the second bypass valve 163 and the first expansion valve 108. The refrigerant gains heat and is evaporated in the outdoor heat exchanger 106. Further, the gaseous refrigerant returns from the outdoor heat exchanger 106 to the compressor 102.

That is, in the heating mode of operation, the outdoor heat exchanger 106 is configured to operate as an evaporator that absorbs heat from the outdoor air, the indoor heat exchanger 112 is configured to operate as a condenser that expels heat to the indoor air, and the reversing valve 104 is configured to direct gaseous refrigerant from the outdoor heat exchanger 106 to the compressor 102 and liquid refrigerant at a high pressure and high temperature from the compressor 102 to the indoor heat exchanger 112.

When the heat pump 100 operates in the heating mode, under certain conditions of temperature and relative humidity, frost might form on the surface of the outdoor heat exchanger 106. For example, under frost conditions, i.e., when the temperature is low, and the relative humidity is high, the vapor in the ambient air may condense and freeze on the heat exchanging surface of the outdoor heat exchanger 106 that operates as an evaporator, thereby forming a layer of ice. The frost formed on the heat exchanging surface of the outdoor heat exchanger 106 will negatively affect the operation of the heat pump 100. To remove the frost formed on the surface of the outdoor heat exchanger 106, the heat pump 100 may include a defrost cycle in which the heat pump is operated in a cooling mode for a while till the frost is melted.

As illustrated in FIG. 1, the heat pump 100 may include a defrost cycle control assembly 180 that is configured to control the defrost cycle of the heat pump 100. The defrost cycle control assembly 180 may include a first sensor 157 that is disposed at a top portion of the heat exchanging surface of the outdoor heat exchanger 106, and a second sensor 155 disposed on the liquid line 116 adjacent an inlet end or at a bottom portion of the outdoor heat exchanger 106. The first and second sensors (157, 155) may include any appropriate temperature detecting sensors without departing from a broader scope of the present disclosure.

The first sensor 157 may be configured to measure a temperature at the top portion of the heat exchanging surface of the outdoor heat exchanger 106. The second sensor 155 may be configured to measure the temperature at the bottom portion of the heat exchanging surface of the outdoor heat exchanger 106 or the temperature on the liquid line adjacent the inlet of the outdoor heat exchanger 106. The temperature on the liquid line adjacent the inlet of the outdoor heat exchanger 106 may indicate and be interchangeably referred to as the heat exchanging surface temperature at the bottom portion of the outdoor heat exchanger 106. Further, the first and second sensors (157, 155) may be configured to generate and transmit sensor data to the controller 114, where the sensor data from each sensor represents the temperature measured by the sensor.

Figure 1B:
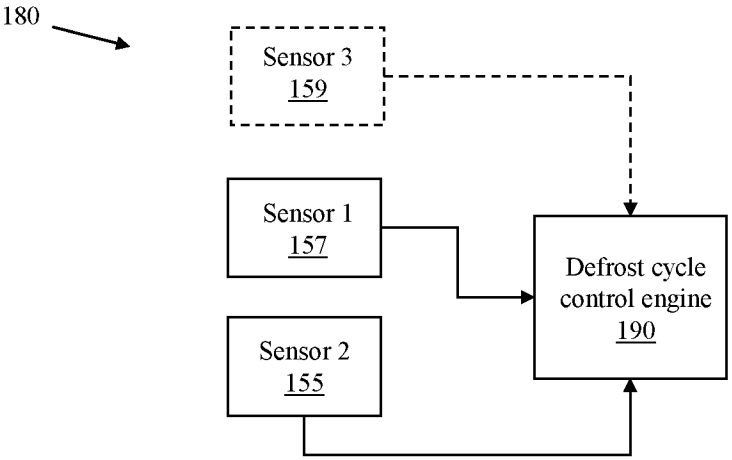
Figure 2:
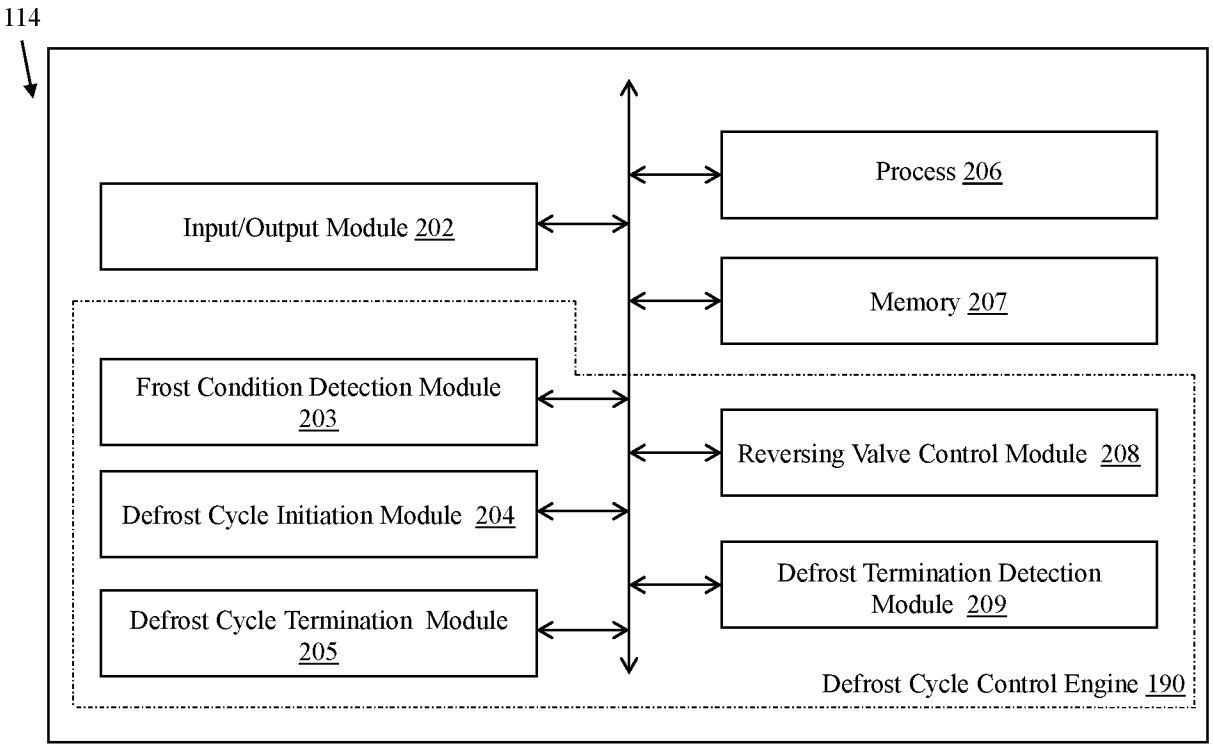
FIG. 2 illustrates an example controller of the example defrost cycle control assembly of the heat pump of FIG. 1, in accordance with example embodiments of the present disclosure.

In some example embodiments, as illustrated in FIGS. 1A and 1B, in addition to the first and second sensors (157, 155) that are configured to measure the temperatures on the heat exchanging surface of the outdoor heat exchanger 106 or on the liquid line, the defrost cycle control assembly 180 may optionally include a third sensor 159 that is configured to the measure an ambient temperature. The third sensor 159 may be disposed on the outdoor heat exchanger 106. Even though the present disclosure describes the defrost cycle control assembly 180 as including temperature sensors, one of skill in the art can understand and appreciate that in some example embodiments, in addition to the temperature sensors, the defrost cycle control assembly may include relative humidity sensors that may be used to further optimize the defrost cycle of the heat pump. Alternatively, in some example embodiments, the third sensor 159 may be configured to measure both the ambient temperature and the relative humidity.

In some example embodiments, in addition to the two temperature sensors (157, 155) positioned adjacent the top and bottom portion of the heat exchanging surface of the outdoor heat exchanger 106, the defrost cycle control assembly can include additional temperature sensors (excluding the third ambient temperature sensor 159) that are disposed at any other portion along the heat exchanging surface of the outdoor heat exchanger to allow and optimize an area-wise defrost of the outdoor heat exchanger 106. For example, in some examples having large heat exchangers, in addition to the first sensor 157 and the second sensor 155, the defrost cycle control assembly 180 may include an additional temperature sensor (excluding the third ambient temperature sensor 159) that is disposed midway between the top portion and bottom portion of the heat exchanging surface of the outdoor heat exchanger 106.

In one example, a vertically oriented micro-channel outdoor heat exchanger may include a heat exchanging surface that is defined by a plurality of micro-channel tubes that are spaced apart from each other and fins disposed between and connecting adjacent micro-channel tubes. The micro-channel tubes may extend from the top to the bottom of the outdoor heat exchanger 106. The micro-channel tubes may be configured to pass refrigerant therethrough from an inlet at the bottom to an outlet at the top or vice-versa based on the mode of operation (e.g., heating or cooling) of the heat pump. In said vertically oriented micro-channel outdoor heat exchanger, the first sensor 157 may be positioned on the fins or on the micro-channel tubes adjacent a top portion of the heat exchanging surface of the outdoor heat exchanger, and the second sensor 155 may be positioned on the fins or on the micro-channel tubes adjacent a bottom portion of the heat exchanging surface of the outdoor heat exchanger or on the liquid line 116 at the inlet of the outdoor heat exchanger. Further, the third sensor 159 that is configured to measure the ambient temperature may be disposed on or attached to a surface of the outdoor unit 150.

In addition to the sensors (157, 155, and/or 159), the defrost cycle control assembly 180 may include a defrost cycle control engine 190 that is configured in the controller 114 of the heat pump 100. The controller 114 may be electrically and communicatively coupled to the first sensor 157, the second sensor 155, and/or the third sensor 159. The controller 114 may be configured to receive sensor data from said sensors (155, 157, and/or 159), where the sensor data represents the temperatures measured by the respective sensors. In another example embodiment, the controller 114 may only be communicatively coupled to the sensors (155, 157, 159). In said another example embodiment, the controller 114 may be configured to wirelessly receive the sensor data from the sensors (155, 157, 159). Responsive to receiving the sensor data, the defrost cycle control engine 190 of the controller 114 may be configured to analyze the received sensor data and control (e.g., start and stop) the defrost cycle of the heat pump 100 based on the measured temperatures from the sensors (155, 157, and/or 159). In particular, the defrost control cycle engine 190 may be configured to control the defrost cycle such that:

(a) unnecessary defrost cycles of the heat pump 100 are reduced and the time between consecutive defrost cycles of the heat pump 100 is extended resulting in extended heating periods in the controlled space served by the heat pump 100, (b) the heat exchanging surface of the outdoor heat exchanger 106 is efficiently used for heat transfer and run time during frost conditions by starting the defrost cycle only when the heat exchanging surface of the outdoor heat exchanger 106 is covered in frost to the extent that the outdoor heat exchanger 106 cannot be efficiently used for providing heat to the controlled space (e.g., when majority of heat exchanging surface of the outdoor heat exchanger 106 has frost thereon or when the heat exchanging surface of the outdoor heat exchanger 106 frosts all the way from the bottom through the top portion), and (c) the temperature gradient from the top portion through the bottom portion of the heat exchanging surface of the outdoor heat exchanger 106 is minimized which in turn prevents the unnecessary shut down of the heat pump 100 that results from the triggering of the pressure switches of the heat pump 100.

The controller 114 may be a microcontroller; however, in other example embodiments, the controller 114 may include any suitable control mechanism that can receive sensor data and control the defrost cycle of the heat pump based on the received sensor data that represents the measured temperatures at different portions of outdoor heat exchanger. For example, the controller 114 may comprise any appropriate combination of analog and/or digital electronics.

The operation of the defrost cycle control assembly 180 to control the defrost cycle of the heat pump 100 will be described below in greater detail in association with FIG. 3 by referring to FIG. 2 which illustrates the various example components of controller 114 and the defrost cycle control engine 190 disposed in the controller 114. FIG. 3 illustrates a flowchart associated with the operation of the defrost cycle control engine 190. Although specific operations are disclosed in the flowcharts illustrated in FIG. 3, such operations are only non-limiting examples. That is, embodiments of the present invention are well suited to performing various other operations or variations of the operations recited in the flowcharts. It is appreciated that the operations in the flowcharts illustrated in FIG. 3 may be performed in an order different than presented, and that not all the operations in the flowcharts may be performed.

Figure 3A:
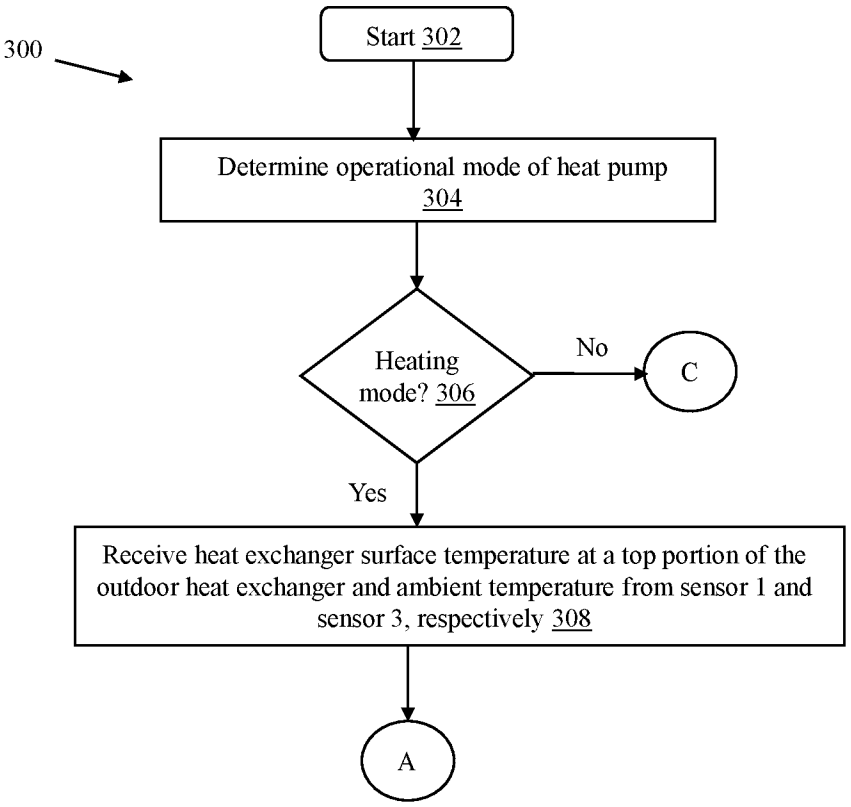
FIG. 3A-3C (collectively 'FIG. 3') are flowcharts that illustrate an example method of controlling a defrost cycle in the example heat pump of FIG. 1 using the defrost cycle control assembly, in accordance with example embodiments of the present disclosure.
Figure 3B:
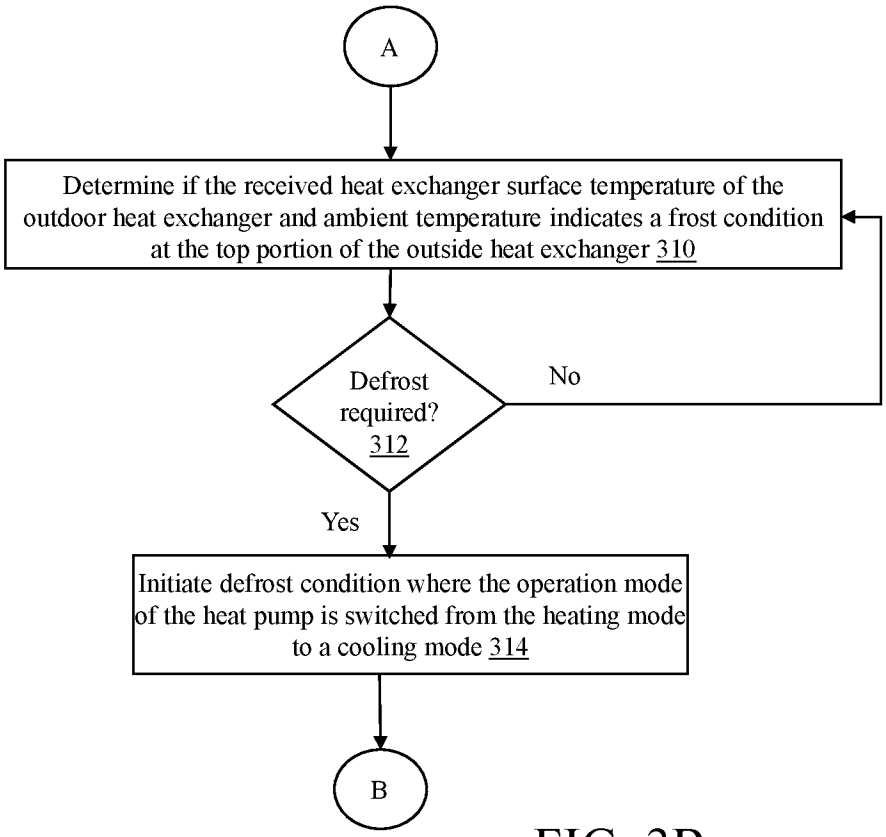
Figure 3C:
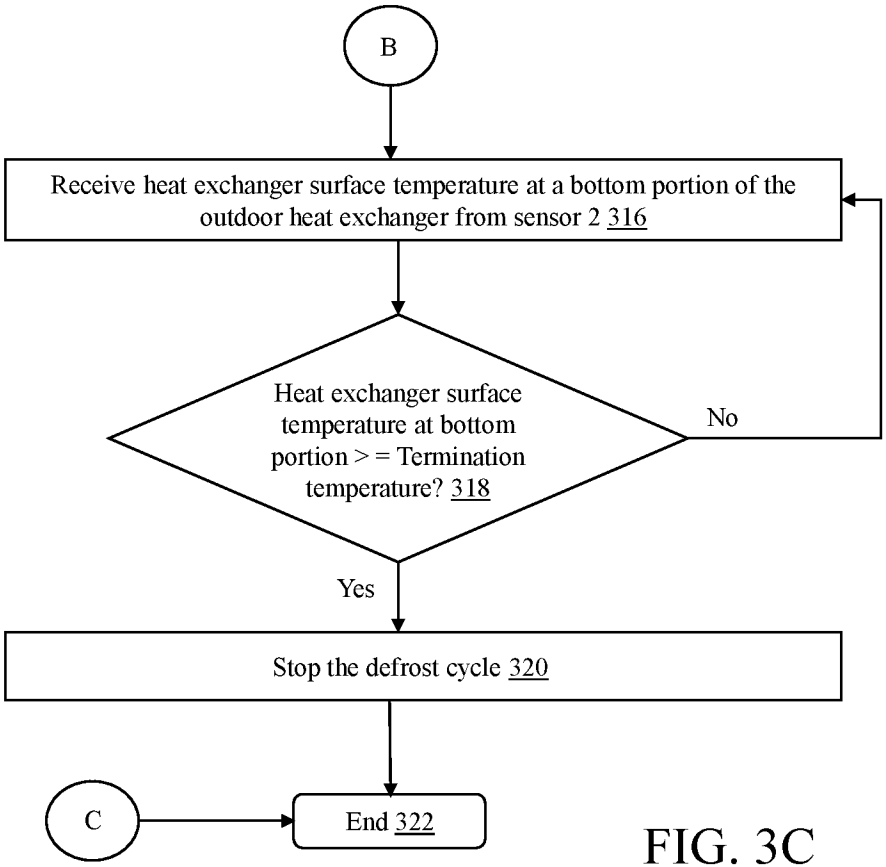

All, or a portion of, the embodiments described by the flowcharts illustrated in FIG. 3 can be implemented using computer-readable and computer-executable instructions which reside, for example, in a memory of the controller 114 or a computer-usable media of a computer system. As described above, certain processes and operations of the present invention are realized, in one embodiment, as a series of instructions (e.g., software programs) that reside within computer readable memory of a computer system and are executed by the processor of the controller. When executed, the instructions cause the controller to implement the functionality of the present invention as described below.

Referring to FIG. 3, the process 300 of controlling a defrost cycle of the heat pump 100 using the defrost cycle control assembly 180 begins at operation 302 and proceeds to operation 304. In operation 304 and 306, the defrost cycle control engine 190 of the defrost cycle control assembly 180 determines whether the heat pump 100 is operating in a heating mode. If the heat pump 100 is not operating in a heating mode, i.e., if the heat pump 100 is operating in a cooling mode, the process 300 ends in operation 322. However, if the heat pump 100 is operating in a heating mode, then, in operation 308, the defrost cycle control engine 190 monitors the sensor data from the first sensor 157 and the third sensor 159 of the defrost cycle control assembly 180. The sensor data from the first sensor 157 may represent the heat exchange surface temperature at a top portion of the outdoor heat exchanger and the sensor data from the third sensor 159 represents an ambient temperature.

In particular, in operation 308, the input/output module 202 of the controller 114 may receive the sensor data from the first sensor 157 and the third sensor 159 and transmit the sensor data to the frost condition detection module 203 of the defrost cycle control engine 190. Responsive to receiving the sensor data from the first sensor 157 and the third sensor 159, in operation 310, the frost condition detection module 203 may determine if the received sensor data indicates a frost condition at the top portion of the outdoor heat exchanger 106. In other words, in operation 310, the frost condition detection module 203 determines whether the frost has reached all the way to the top portion of the heat exchanging surface of the outdoor heat exchanger 106.

In one example embodiment, the frost condition detection module 203 may detect the frost condition at the top portion of the outdoor heat exchanger 106 based on a temperature difference between the heat exchanger surface temperature at the top portion of the outdoor heat exchanger 106 and the ambient temperature. For example, a temperature difference between heat exchanger surface temperature at the top portion of the outdoor heat exchanger 106 and the ambient temperature when there is no frost on the heat exchanging surface of the outdoor heat exchanger 106 may be previously calibrated and recorded in a memory 207 of the controller 114. Said temperature difference between heat exchanger surface temperature at the top portion of the outdoor heat exchanger 106 and the ambient temperature when there is no frost on the heat exchanging surface of the outdoor heat exchanger 106 may be referred to as a clean coil temperature difference. If there is no frost at the top portion of the heat exchanging surface of the outdoor heat exchanger 106, the measured temperature difference between heat exchanger surface temperature at the top portion of the outdoor heat exchanger 106 and the ambient temperature may remain substantially similar to the clean coil temperature difference. However, when there is frost at the top portion of the heat exchanging surface of the outdoor heat exchanger 106, the temperature difference between heat exchanger surface temperature at the top portion of the outdoor heat exchanger 106 and the ambient temperature may vary from the clean coil temperature by a threshold amount. Accordingly, when the temperature difference between heat exchanger surface temperature at the top portion of the outdoor heat exchanger 106 and the ambient temperature varies from the clean coil temperature by or more than a threshold amount, the frost condition detection module 03 determines that the frost has reached the top portion of the outdoor heat exchanger 106 where the first sensor 157 is positioned.

In some example embodiments, the defrost cycle control assembly 180 may not include the third sensor 159 that is configured to measure the ambient temperature. In said example embodiments that do not include the third sensor 159, the frost condition detection module 203 may be configured to determine a frost condition at the top portion of the outdoor heat exchanger 106 solely based on the sensor data from the first sensor 157. For example, if the heat exchanger surface temperature at the top portion of the outdoor heat exchanger 106 as measured by the first sensor 157 is greater than a pre-set threshold temperature, the frost condition detection module 203 determines a frost condition at the top portion of the outdoor heat exchanger 106 where the first sensor 157 is positioned.

In other example embodiments, in addition to the heat exchanger surface temperature at the top portion of the outdoor heat exchanger 106 and the ambient temperature, the frost condition detection module 203 may be configured to use information regarding relative humidity or any other additional factors measured by additional sensors to determine the frost condition at the top portion of the outdoor heat exchanger 106 without departing from a broader scope of the present disclosure.

In either case, responsive to determining a frost condition at the top portion of the outdoor heat exchanger 106, in operation 312 the frost condition detection module 203 determines if the defrost cycle of the heat pump 100 must be initiated. In one example embodiment, the frost condition detection module 203 may be configured to initiate the defrost cycle based on the temperature difference between heat exchanger surface temperature at the top portion of the outdoor heat exchanger 106 and the ambient temperature. For example, the frost condition detection module 203 may be configured to initiate the defrost cycle when the temperature difference between heat exchanger surface temperature at the top portion of the outdoor heat exchanger 106 and the ambient temperature (hereinafter 'top temperature difference') is greater than the clean coil temperature difference by a threshold value. However, in some example embodiments, to ensure that the frost extends all the way from the bottom portion to the top portion of the heat exchanging surface of the outdoor heat exchanger 106 and is not just concentrated at the top portion of the outdoor heat exchanger, the frost condition detection module 203 may be configured to initiate the defrost cycle based on the top temperature difference and also the sensor data from the second sensor 157 that represents the heat exchanger surface temperature at the bottom portion of the outdoor heat exchanger 106. For example, the frost condition detection module 203 may be configured to initiate the defrost cycle when the top temperature difference is greater than the clean coil temperature difference by a threshold value and the heat exchanger surface temperature at the bottom portion of the outdoor heat exchanger 106 is greater than a threshold temperature.

In either case, upon determining that the defrost cycle is to be initiated, in operation 314, the frost condition detection module 203 may operate in concert with the defrost cycle initiation module 204 and the reversing valve control module 208 to initiate the defrost cycle. In the defrost cycle, the reversing valve control module 208 is configured to control the reversing valve 104 of the heat pump 100 to change an operation of the heat pump 100 from a heating mode to a cooling mode. Responsive to initiating the defrost cycle, i.e., switching the operation of the heat pump from a heating mode to a cooling mode, in operation 316, the defrost termination detection module 209 may monitor the sensor data from the second sensor 157.

In operation 318, the defrost termination detection module 209 determines whether the heat exchanging surface temperature at the bottom portion of the outdoor heat exchanger 106 or on the temperature at the liquid line 160 adjacent an input of the outdoor heat exchanger 106 is equal to or greater than a termination temperature. The termination temperature may be set to ensure that the frost has melted from the bottom portion of the outdoor heat exchanger when the heat exchanging surface temperature at the bottom portion of the outdoor heat exchanger 106 or on the temperature at the liquid line 160 adjacent an input of the outdoor heat exchanger 106 has reached or exceeded the termination temperature. In other words, operation 318 may be configured to determine that the frost on the heat exchanging surface of the outdoor heat exchanger 106 has melted all the way to the bottom portion thereof.

Responsive to determining that the heat exchanging surface temperature at the bottom portion of the outdoor heat exchanger 106 or the temperature at the liquid line 160 adjacent an input of the outdoor heat exchanger 106 is equal to or greater than a termination temperature, in operation 320, the defrost termination detection module 209 may operate in concert with the defrost cycle termination module 205 and the reversing valve control module 208 to terminate or stop the defrost cycle. In particular, the defrost cycle termination module 205 and the reversing valve control module 208 operate in concert to revert the operation of the heat pump from the cooling mode back to the heating mode using the reversing valve 104.

Further, as a back-up or a fail-safe mechanism, if the heat exchanging surface of the outdoor heat exchanger 106 has had frost built thereon for a predetermined amount of time, the defrost cycle control engine 190 may be configured to automatically initiate the defrost cycle of the heat pump 100.

The processor 206 of the controller 114 may be a multi-core processor or a combination of multiple single core processors. Further, the memory 207 that is coupled to the processor 206 may be non-transitory storage medium, in one embodiment, and a transitory storage medium in another embodiment. The memory 207 may include instructions that may be executed by the processor 206 to perform operations of the defrost cycle control engine 190 and other operations of the controller 114. In other words, operations associated with the different modules 203-205, 208, 209 may be executed using the processor 206.

The process 300 of the defrost cycle control assembly 180 that initiates and terminates the defrost cycle based on the surface temperature of the outdoor heat exchanger at two different locations thereof optimizes the defrost cycle of the heat pump by ensuring that the defrost cycle is only initiated when most of the heat exchanging surface of the outdoor heat exchanger is covered with frost to an extent that the heating mode of the heat pump cannot be efficiently operated. Even though the present disclosure describes the first sensor 157 that determines the initiation of the defrost cycle is placed on a top portion of the outdoor heat exchanger, one of skill in the art can understand and appreciate that in other example embodiments, the first sensor 157 may be attached at any other optimal portion on the heat exchanging surface of the outdoor heat exchanger 106 without departing from a broader scope of the present disclosure. For example, the first sensor 157 may be positioned between the top portion and the bottom portion of the heat exchanging surface of the outdoor heat exchanger 106 such that the defrost cycle is initiated when 80% of the heat exchanging surface extending from the bottom portion to the top portion thereof has been covered by frost.

In one example, an outdoor heat exchanger 106 may include a heat exchanging surface that is defined by a plurality of micro-channel refrigerant tubes and fins disposed therebetween. The micro-channel refrigerant tubes may extend from a first end of the outdoor heat exchanger to a second end thereof The second end may be opposite to the first end and spaced apart therefrom. In said example, a first sensor 157 of the defrost cycle control assembly 180 may be positioned on the heat exchanging surface of the outdoor heat exchanger 106 and adjacent a first end thereof. Further, the second sensor 155 of the defrost cycle control assembly 180 may be positioned either on the heat exchanging surface of the outdoor heat exchanger 106 and adjacent the second end thereof or on a liquid line that is connected to the outdoor heat exchanger 106 adjacent a point of connection therebetween. Furthermore, the defrost cycle control assembly 180 may include an optional third sensor 159 that may be coupled to the outdoor unit 150 of the heat pump 100 that houses the outdoor heat exchanger 106.

The first sensor 157 and the second sensor 155 may be temperature sensors that are configured to measure surface temperatures of the surfaces on which they are disposed. The third sensor 159 may also be a temperature sensor but may be configured to measure ambient temperature and/or relative humidity. The first sensor 159, the second sensor 155, and/or the third sensor 159 may be communicatively and/or electrically coupled to a defrost cycle control engine 190 of the defrost cycle control assembly 180 via a controller 114 of the heat pump 100.

In said example, the defrost cycle control engine 180 may be configured to initiate a defrost cycle of the heat pump 100 based on sensor data from the first sensor 157 and/or the third sensor 159. In other words, the defrost cycle may be initiated based on a surface temperature of the heat exchanging surface adjacent a first end of the outdoor heat exchanger 106 where the first sensor 157 is disposed and/or the ambient conditions (temperature and humidity). If the surface temperature as measured by the first sensor 157 and the ambient conditions measured by the third sensor 159 indicate that there is frost formation on the heat exchanging surface of the outdoor heat exchanger 106 and the frost has reached adjacent the first end of the outdoor heat exchanger 106 where the first sensor 157 is located, the defrost cycle is initiated. Responsive to initiating the defrost cycle, the defrost cycle control engine 180 may be configured to terminate the defrost cycle based on sensor data from the second sensor 155. In other words, the defrost cycle may be terminated if the defrost cycle control engine 190 determines that a surface temperature of the heat exchanging surface adjacent a second end of the outdoor heat exchanger 106 where the second sensor 155 is disposed has reached a termination temperature which in turn indicates that the frost has melted all way to the second end of the outdoor heat exchanger 106. In some example embodiments, the first end may be a top end and adjacent an outlet of the outdoor heat exchanger 106, and the second may be a bottom end and adjacent an inlet of the outdoor heat exchanger 106.

Although the present embodiments have been described with reference to specific example embodiments, it will be evident that various modifications and changes may be made to these embodiments without departing from the broader spirit and scope of the various embodiments. For example, the various devices, engines, and modules described herein may be enabled and operated using hardware circuitry (e.g., CMOS based logic circuitry), firmware, software or any combination of hardware, firmware, and software (e.g., embodied in a machine readable medium). For example, the various electrical structures and methods may be embodied using transistors, logic gates, and electrical circuits (e.g., application specific integrated (ASIC) circuitry and/or in Digital Signal Processor (DSP) circuitry).

The terms "invention," "the invention," "this invention," and "the present invention," as used herein, intend to refer broadly to all disclosed subject matter and teaching, and recitations containing these terms should not be misconstrued as limiting the subject matter taught herein or to limit the meaning or scope of the claims. From the description of the exemplary embodiments, equivalents of the elements shown therein will suggest themselves to those skilled in the art, and ways of constructing other embodiments of the present invention will appear to practitioners of the art. Therefore, the scope of the present invention is to be limited only by the claims that follow.

In addition, it will be appreciated that the various operations, processes, and methods disclosed herein may be embodied in a machine-readable medium and/or a machine accessible medium compatible with a data processing system (e.g., a computer system), and may be performed in any order (e.g., including using means for achieving the various operations). Accordingly, the specification and drawings are to be regarded in an illustrative rather than a restrictive sense.

What is claimed is:

1. A controller configured to control at least a portion of a heat pump system, the controller comprising:

one or more processors; and memory having instructions stored thereon that, when executed by the one or more processors, causes the controller to:

receive first temperature data from a first sensor, the first temperature data being indicative of a temperature at a first portion of an outdoor heat exchanger of the heat pump system, wherein the first portion is a top portion of a heat exchanging surface of the outdoor heat exchanger;

receive second temperature data from a second sensor, the second temperature data being indicative of a temperature at a second portion of the outdoor heat exchanger, wherein the second portion is a bottom portion of the heat exchanging surface of the outdoor heat exchanger;

receive ambient temperature data from a third sensor, the ambient temperature data being indicative of an ambient temperature;

determine that frost has formed at the first portion of the outdoor heat exchanger based at least in part on the first temperature data and the ambient temperature;

determine that frost has formed at the second portion of the outdoor heat exchanger based at least in part on the second temperature data and the ambient temperature;

initiate a defrost cycle after determining that frost has formed at both the first portion and the second portion; and terminate the defrost cycle based at least in part on the second temperature data.

2. The controller of claim 1, wherein the outdoor heat exchanger is a micro-channel heat exchanger.

3. The controller of claim 1, wherein the first portion of the outdoor heat exchanger is the heat-exchanging surface of the outdoor heat exchanger such that the first temperature data is indicative of a temperature at the heat-exchanger surface.

4. The controller of claim 1, wherein the second portion of the outdoor heat exchanger is the heat-exchanging surface of the outdoor heat exchanger such that the second temperature data is indicative of a temperature at the heat-exchanger surface.

5. The controller of claim 1, wherein the second portion of the outdoor heat exchanger is a liquid line such that the second temperature data is indicative of a temperature at the liquid line.

6. The controller of claim 1, wherein determining that frost has formed at the first portion of the outdoor heat exchanger based at least in part on the first temperature data and the ambient temperature comprises:

determining that a temperature difference between the temperature at the first portion and the ambient temperature is greater than a sum of a clean coil temperature difference and a threshold value, the clean coil temperature difference corresponding to a temperature difference between the temperature at the first portion and the ambient temperature when first portion is free of frost.

7. The controller of claim 1, wherein the controller is further configured to:

output instructions for the heat pump system to operate in a cooling mode wherein the outdoor heat exchanger operates as a condenser.

8. The controller of claim 1, wherein terminating the defrost cycle is based at least in part on determining that the temperature at the second portion indicates that frost has melted from a heat-exchanging surface at the second portion.

9. The controller of claim 8, wherein determining that the temperature at the second portion indicates that frost has melted from the heat-exchanging surface at the second portion comprises determining that the temperature at the second portion is greater than or equal to a termination temperature.

10. The controller of claim 9, wherein the instructions, when executed by the one or more processors, further causes the controller to:

receive relative humidity data from a fourth sensor, the relative humidity data being indicative of a relative humidity, wherein:

determining that frost has formed at the first portion of the outdoor heat exchanger is further based at least in part on the relative humidity, or determining that frost has formed at the second portion of the outdoor heat exchanger is further based at least in part on the relative humidity.

11. The controller of claim 8, wherein the second portion is a bottom portion of the heat exchanging surface of the outdoor heat exchanger.

12. A system comprising:

a heat exchanger;

a first sensor configured to measure a temperature at a first portion of the heat exchanger, wherein the first portion is a top portion of the heat exchanger;

a second sensor configured to measure a temperature at a second portion of the heat exchanger, the second portion being different from the first portion, wherein the second portion is a bottom portion of the heat exchanger; and a controller configured to:

receive first temperature data from the first sensor, the first temperature data being indicative of the temperature at the first portion;

receive second temperature data from the second sensor, the second temperature data being indicative of the temperature at the second portion; and initiate a defrost cycle of the in response to determining that both the first and second temperature data indicate frost formation at the first and second portions, respectively.

13. The system of claim 12, wherein the heat exchanger is a micro-channel heat exchanger.

14. The system of claim 12, wherein the controller is further configured to:

terminate the defrost cycle based at least in part on determining that the temperature at the second portion is greater than or equal to a termination temperature.

15. The system of claim 12, wherein the first portion is a heat-exchanging surface of the heat exchanger.

16. The system of claim 12, wherein the second portion is a heat-exchanging surface of the heat exchanger.

17. The system of claim 12, wherein the second sensor is disposed on a liquid line that is connected to the heat exchanger.

* * * * *